US010099288B2

(12) United States Patent
Doye et al.

(10) Patent No.: US 10,099,288 B2
(45) Date of Patent: Oct. 16, 2018

(54) METHOD FOR PRODUCING A SHELL-SHAPED COMPONENT AND PRODUCTION SYSTEM SUITABLE FOR THE USE OF SAID METHOD

(71) Applicant: Siemens Aktiengesellschaft, Munich (DE)

(72) Inventors: Christian Doye, Berlin (DE); Ursus Krueger, Berlin (DE); Oliver Stier, Berlin (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 393 days.

(21) Appl. No.: 14/892,049

(22) PCT Filed: May 12, 2014

(86) PCT No.: PCT/EP2014/059612
§ 371 (c)(1),
(2) Date: Nov. 18, 2015

(87) PCT Pub. No.: WO2014/187688
PCT Pub. Date: Nov. 27, 2014

(65) Prior Publication Data

US 2016/0107231 A1 Apr. 21, 2016

(30) Foreign Application Priority Data

May 22, 2013 (DE) ..... 10 2013 209 477
Aug. 20, 2013 (DE) ..... 10 2013 216 439

(51) Int. Cl.
*B22F 3/04* (2006.01)
*C23C 24/04* (2006.01)
(Continued)

(52) U.S. Cl.
CPC ..... *B22F 3/04* (2013.01); *B22F 3/115* (2013.01); *B22F 5/10* (2013.01); *C23C 24/04* (2013.01)

(58) Field of Classification Search
CPC .... B22F 3/04; B22F 3/115; B22F 5/10; C23C 24/04
(Continued)

(56) References Cited

U.S. PATENT DOCUMENTS 4,775,092 A 10/1988 Edmonds et al. ..... 228/222
5,257,657 A 11/1993 Gore ..... 164/46
(Continued)

FOREIGN PATENT DOCUMENTS

DE 1964167 A1 7/1970 ..... B29C 33/04
DE 2524806 A1 12/1976 ..... B21D 37/20
(Continued)

OTHER PUBLICATIONS

German Office Action, Application No. 102013216439.4, 5 pages, dated Jan. 13, 2014.
(Continued)

*Primary Examiner* — Mark A Chapman
(74) *Attorney, Agent, or Firm* — Slayden Grubert Beard PLLC

(57) ABSTRACT

A method for producing a shell-shaped component and a production system for producing such a component are disclosed. Thee component is produced by a cold gas stream by cold gas spraying. The particles of the cold gas stream are applied to the edge of the component being produced, wherein simultaneously a supporting body is used, which supports the component only at the point of incidence of the cold gas stream. In this way, the form of the component can be shaped by suitably moving the supporting body and the cold spray nozzle, without having to produce a core that fills
(Continued)

the entire volume of the shell-shaped component. Thus, the method may be especially economical for small quantities, because the supporting body can be used universally for components of different geometries.

14 Claims, 3 Drawing Sheets

(51) Int. Cl.
*B22F 3/115* (2006.01)
*B22F 5/10* (2006.01)

(58) Field of Classification Search
USPC ..... 419/66
See application file for complete search history.

(56) References Cited

U.S. PATENT DOCUMENTS

| | | | | |
|---|---|---|---|---|
| 5,817,267 | A | 10/1998 | Covino et al. | 264/219 |
| 8,316,916 | B2 | 11/2012 | Heinrich et al. | 164/46 |
| 9,101,040 | B2 | 8/2015 | Heid | |
| 2012/0273152 | A1 | 11/2012 | Heinrich et al. | 164/46 |

FOREIGN PATENT DOCUMENTS

| | | | | |
|---|---|---|---|---|
| DE | 69628578 | T2 | 5/2004 | B22D 17/22 |
| DE | 60023120 | T2 | 9/2006 | B22D 23/00 |
| DE | 102010040855 | A1 | 3/2012 | H05H 5/02 |
| DE | 102010060362 | A1 | 5/2012 | B21C 37/06 |
| DE | 102011100123 | A1 | 10/2012 | C23C 4/12 |
| WO | 2004/065052 | A1 | 8/2004 | B23K 26/34 |
| WO | 2009/109016 | A1 | 9/2009 | B21C 37/06 |
| WO | 2014/187688 | A1 | 11/2014 | B22F 3/115 |

OTHER PUBLICATIONS

Canadian Office Action, Application No. 2913073, 6 pages, dated Jan. 30, 2017.

METHOD FOR PRODUCING A SHELL-SHAPED COMPONENT AND PRODUCTION SYSTEM SUITABLE FOR THE USE OF SAID METHOD

CROSS-REFERENCE TO RELATED APPLICATIONS

This application is a U.S. National Stage Application of International Application No. PCT/EP2014/059612 filed May 12, 2014, which designates the United States of America, and claims priority to DE Application No. 10 2013 209 477.9 filed May 22, 2013 and DE Application No. 10 2013 216 439.4 filed Aug. 20, 2013, the contents of which are hereby incorporated by reference in their entirety.

TECHNICAL FIELD

The invention relates to a method for producing a shell-shaped component having a wall and a depression open toward the opening in said component. Moreover, the invention relates to a production system for a component, having a cold spraying nozzle and a holding fixture for the component, wherein the cold spraying device and the holder can be moved relative to one another.

BACKGROUND

A method of the type stated at the outset is widely known. Shell-shaped components are preferably produced by deep drawing. During this process, a metal sheet is processed by forming over a former (die). However, it is only possible to produce components economically in this way in relatively large numbers since the forming tools are relatively expensive to produce and therefore have a negative effect on unit costs in the case of relatively small numbers. This also applies to production by casting since, in this case, casting molds have to be produced. In principle, it is also technically possible to use machining, e.g. milling. However, a large volume has to be cut away in the case of shell-shaped components, for which reason this method is not economically feasible because of the expense of production.

SUMMARY

One embodiment provides a method for producing a shell-shaped component, having a wall and a depression open toward an opening, wherein said component is produced by cold gas spraying, wherein a supporting body having a curved surface composed of a material to which the particles of the cold gas jet do not adhere is made available, a starting structure is fixed temporarily on the surface, and the component is produced by application of material from the cold gas jet in each case to the edge of the component being formed, wherein the supporting body and the cold gas jet are moved synchronously in such a way that the cold gas jet impinges on the edge at an angle within the cold spraying cone, and the supporting body supports the component being formed at the point of impact of the cold gas jet.

According to another embodiment, a bowl-shaped component is produced.

According to another embodiment, an electrode shell of a particle accelerator is produced as a component.

According to another embodiment, the supporting body is composed of a hard metal.

According to another embodiment, the supporting body has a surface which has the shape of a sphere or of a spherical segment.

According to another embodiment, the supporting body is of concave design.

According to another embodiment, titanium or tantalum are used as the material.

According to another embodiment, a plurality of supporting bodies having different radii of curvature of the curved surface thereof are made available.

According to another embodiment, the cold spraying nozzle and/or the supporting body are each guided by a robot arm.

According to another embodiment, a structure in the form of a closed ring is used as a starting structure, defining the rim of the opening of the shell-shaped component, and in that the wall of the component is built up starting from the starting structure.

According to another embodiment, the starting structure is produced as a structure in the form of a closed ring on a base by cold gas spraying and defines the rim of the opening of the shell-shaped component, and in that the wall of the component is built up starting from the starting structure.

Another embodiment provides a production system for a component, having a cold spraying nozzle and a holding fixture for the component, wherein the cold spraying device and the holder can be moved relative to one another, wherein the production system furthermore has a supporting body, which has a convexly or concavely curved surface and can be moved relative to the holder.

According to another embodiment, the supporting body is secured on a robot arm.

According to another embodiment, the cold spraying nozzle is secured on a robot arm.

BRIEF DESCRIPTION OF THE DRAWINGS

Example embodiments of the invention are described below with reference to the drawings, in which.

DETAILED DESCRIPTION

Figure 1:
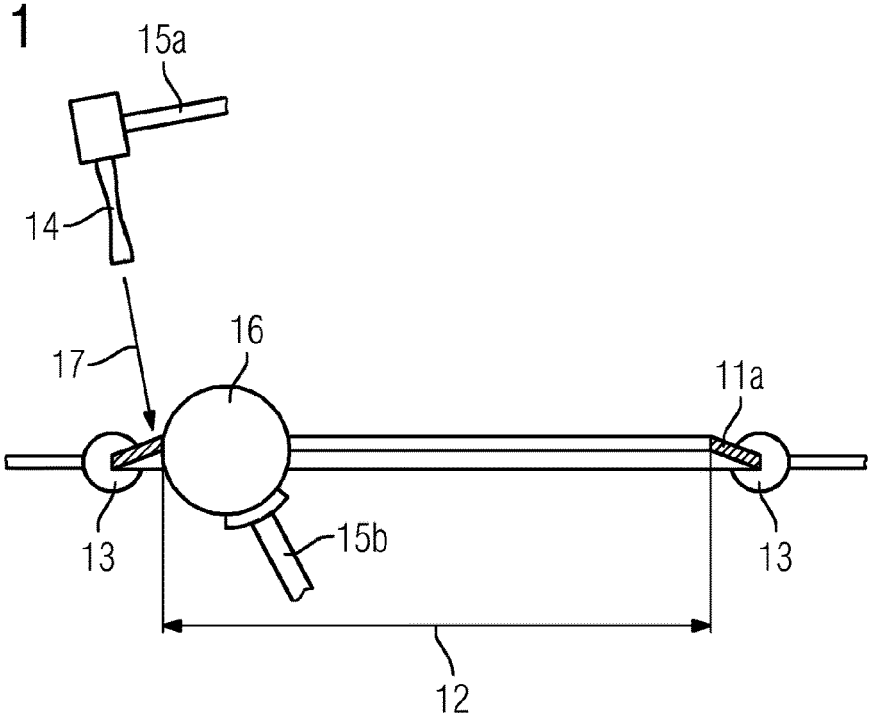
FIGS. 1 and 2 show selected steps of one illustrative embodiment of the method according to the invention in sectional representation.

In the sense according to the invention, shell-shaped components should be taken to mean components whose shell thickness, i.e. wall thickness of the wall, is small relative to the overall dimensions of the component. For example, "small" should be taken to mean a ratio at which the mean shell thickness of the component is less than 5%, preferably even less than 2% and, even more preferably, even less than 0.5%, of the longest overall dimension of said component. Shell components of this kind find multiple uses in industry. According to DE 10 2010 040 855 A1, use of such shell-shaped components in direct-current particle accelerators is described, for example. These particle accelerators have electrodes which are nested one inside the other and are therefore composed of shell-shaped components of different dimensions. These electrodes are therefore produced only in small numbers, and there is an interest in being able to produce these electrodes economically. The object of the invention is therefore, on the one hand, to indicate a method for producing a shell-shaped component by means of which shell-shaped components can be produced economically, even in small numbers.

The production system indicated at the outset is likewise known from the prior art. Cold gas spraying and a system suitable for the use of this method are described in DE 690 164 33 T2, for example. Here, a particle jet is greatly accelerated by a pressurized gas through a nozzle of convergent-divergent design, leading to deposition of the particles on a suitable substrate.

Ideally, the particle jet is set at a spraying angle $\alpha=0°$ (that is to say that the cold gas jet axis is perpendicular to the surface to be coated). Any difference from this in the orientation of the jet axis leads to a positive value of the spraying angle $\alpha$. Depending on the boundary conditions, such as the particles used, the surface material and the spraying parameters, there is a reliable interval for the spraying angle, within which the adhesion of the deposited particles reaches maximum values. The zero angle can be contained or not contained in this interval. The family of all permissible spraying angles thus results in a volume between two cone surfaces, the tips of which coincide at the point of impact of the particle jet. If the zero angle is contained in the interval (which is normally the case), all that is required to describe the spraying angle interval is a cone, referred to as the cold spraying cone, which is aligned in the manner described.

Cold gas spraying is a method known per se, in which particles provided for coating are accelerated by means of a convergent-divergent nozzle, preferably to supersonic speed, to ensure that they adhere to the surface to be coated owing to the kinetic energy imparted to them. During this process, the kinetic energy of the particles is used, leading to plastic deformation of said particles, wherein the coating particles are melted only at the surface thereof upon impact. This method is therefore referred to as cold gas spraying, in contrast to other thermal spraying methods, because it is carried out at relatively low temperatures, at which the coating particles remain substantially solid. For cold gas spraying, which is also referred to as kinetic spraying, use is preferably made of a cold gas spraying system which has a gas heating device for heating a gas. A stagnation chamber is connected to the gas heating device, said chamber being connected on the outlet side to the convergent-divergent nozzle, preferably a Laval nozzle. Convergent-divergent nozzles have a converging segment and a widening segment, which are connected by a nozzle throat. On the outlet side, the convergent-divergent nozzle produces a powder jet in the form of a gas stream containing particles at high speed, preferably supersonic speed. By means of the cold gas jet, it is possible to deposit layers in order, for example, to produce a tube on a cylindrical tube die, as described in DE 10 2010 060362 A1.

It is therefore a further object of the invention to modify a production system for cold gas spraying in such a way that the method indicated at the outset can be carried out with said system. This means that it should be possible to carry out the production of shell-shaped components at an advantageously low cost by means of the production system, even in the case of small series.

According to the invention, the first-mentioned object is achieved by means of the method indicated at the outset through the following measures. The component is produced by cold gas spraying. During this process, a supporting body having a curved surface composed of a material to which the particles of the cold gas jet do not adhere is made available. A starting structure can be fixed temporarily on the surface of this supporting body. This fixing must not involve close bonding, e.g. material bonding, of the starting structure with the supporting body. However, a better option is to hold the starting structure by means of a holding fixture and in this way to bring it into contact with the supporting body.

When reference is made in connection with the invention to the fact that the particles of the cold gas jet do not adhere to the material of the supporting body, this depends significantly on the choice of spraying angle. If the spraying angle is 0°, it is possible to deposit layers on most materials, whereas this is not possible if the spraying angle lies outside the cold spraying cone. In other words, it is advantageously possible to select a supporting body to which the particles of the cold gas jet will adhere as little as possible by reference to the fact that the particles to be deposited cannot be deposited on the material of the supporting body or can only be deposited thereon in a relatively acute cold spraying cone.

According to the invention, provision is furthermore made for the component to be produced by application of material from the cold gas jet in each case to the edge of the component being formed, wherein the supporting body and the cold gas jet are moved synchronously in such a way that the cold gas jet impinges on the edge at an angle within the cold spraying cone of the edge but outside the cold spraying cone of the supporting body. The edge of the component being produced will always be at an angle to the supporting body at which the surface of the supporting body is aligned so that, in relation to the supporting body, the cold gas jet is outside the cold spraying cone. The alignment of the surface of the edge relative to the surface of the supporting body is preferably about 90° or at least more than 70° to 90°. This gives rise to the effect according to the invention that the supporting body supports the component being formed at the point of impact of the cold gas jet. By virtue of the fact that production of the component by cold gas spraying only ever requires support of the component in the region of impact of the cold gas jet, the volume of the supporting body can advantageously be very much smaller than the internal volume of the depression in the shell-shaped component. All that is required is that, in the case of a convex surface of the supporting body, the radius of curvature at the point of impact of the cold gas jet should be just less than the local radius of curvature of the shell-shaped component on the inside. If a concave supporting structure is used, the radius of curvature of the component must then be smaller on the outside than the radius of curvature of the supporting structure. Only in this way is it possible to ensure that the supporting structure can in each case hug the part of the shell-shaped component which is being formed, preferably tangentially, and thereby supports said part.

The component can advantageously be of bowl-shaped design. This means that the shell-shaped component is rotationally symmetrical and the axis of symmetry is perpendicular to the plane containing the opening. As a particularly preferred option, the component can be produced as an electrode shell of a particle accelerator.

According to another embodiment of the invention, it is envisaged that the supporting body is composed of a hard metal.

This material has the advantage that particles are deposited relatively poorly on this material by means of cold gas spraying and therefore that good use can be made of the supporting effect of a supporting body produced in this way. Moreover, a supporting body of this kind is subject to only a small amount of wear, and therefore it need only be replaced infrequently.

According to another embodiment of the invention, it is envisaged that the supporting body has a surface which has the shape of a sphere or of a spherical segment. These shapes of the supporting body belong to the group of supporting bodies with a convex surface. Spherical supporting bodies are advantageously simple to handle since the same radius of curvature is always available for support, irrespective of the positioning of the sphere relative to the component wall being formed. According to another embodiment, the supporting body is designed with a concave surface, wherein this concave surface too can advantageously form that of a spherical segment.

Even materials which are intrinsically difficult to work, such as titanium and tantalum, can advantageously be deposited according to the invention, using the method. It is thereby advantageously possible to give even these materials a wider application.

According to a special embodiment of the method, it is envisaged that a plurality of supporting bodies having different radii of curvature of the curved surface thereof are made available. These can then be interchanged in the method, it being advantageously possible in this way to produce even shell-shaped components, the radii of curvature of the shell of which are locally different (i.e. shapes other than spherical shells). In this case, account must be taken of the fact that the radius of curvature of the supporting body must not differ too greatly from the radius of curvature of the wall which is to be produced at any given time since the supporting effect will otherwise be too small.

It is particularly advantageous if the cold spraying nozzle and/or the supporting body are each guided by a robot arm. Through guidance by means of a robot arm, it is advantageously possible to align the cold spraying nozzle and the supporting body in an optimum manner relative to one another, thereby increasing the variety of shapes of bowl-shaped components which can be produced. In order to achieve a possibility for guiding the cold spraying nozzle and/or the supporting body which is as independent as possible in terms of space, the robot arm can advantageously have at least three axes in each case. Of course, more degrees of freedom increase the geometric flexibility of the overall system.

Another embodiment of the invention is obtained if a structure in the form of a closed ring is used as a starting structure, defining the rim of the opening of the shell-shaped component, wherein the wall of the component is built up starting from the starting structure. The structure must be in the form of a closed ring to ensure that it forms a rim of the opening of the shell-shaped component. However, this does not mean that this opening must be in the form of a circular ring. In the sense according to the invention, closed in the form of a ring should merely be taken to mean that the starting structure is of elongate design and has no beginning and no end.

The starting structure can also advantageously be produced as a structure in the form of a closed ring on a base by cold gas spraying. This then forms the rim of the opening of the shell-shaped component, and the wall is built up by cold gas spraying, starting from the starting structure. The associated advantages have already been described above. In addition, there is the advantage that the base is better suited to the deposition of material by cold gas spraying than the supporting body, which is intrinsically difficult to coat so that the particles do not adhere to it as it supports the wall to be produced.

According to the invention, the object as it is directed to the production system indicated at the outset is achieved in that the production system has a supporting body, which has a convexly or concavely curved surface and can be moved relative to the holder. The advantages associated with the use of such a supporting body have already been mentioned in connection with the method described above. The free mobility of the supporting body and of the cold spraying nozzle ensure that the movement of these two elements can be synchronized in order to assist locally the deposition of particles on the edge of the component being produced. In connection with the production system, it should be noted that the relative mobility of the holding fixture for the component to be produced, the cold spraying nozzle and the supporting body can be brought about not just by a movement of the cold spraying nozzle and the supporting body alone, but also by a movement of the component in the holding fixture. Particularly in the case of rotationally symmetrical components, there is the possibility, for example, of rotating the bowl-shaped component about its axis of rotation. The cold spraying nozzle and the supporting body need then only perform pivoting movements in one plane. Depending on the application, the design of the production system can therefore be simplified. However, this simplification is obtained at the expense of a reduced geometric flexibility of the production system. A technical compromise has to be found here.

According to an advantageous embodiment of the production system according to the invention, the supporting body can be secured on a robot arm. It is likewise possible, according to another embodiment of this production system, for the cold spraying nozzle to be secured on a robot arm. It is thereby advantageously possible to achieve a relatively high flexibility of the production system. Particularly if the robot arms have several rotational degrees of freedom (3 or more), a free-form surface of any desired geometry can advantageously be produced without major tooling expenditure in the production system.

The way in which the method according to the invention is started can be seen in FIG. 1. For this purpose, a starting structure 11*a* is provided, this being of annular design and forming the rim of an opening 12, to be produced, of a shell-shaped component to be produced, which is not yet visible. The starting structure 11*a* is fixed by means of a holding fixture 13.

In order to generate the wall of the component to be produced, a cold spraying nozzle 14, which is secured on a robot arm 15, is directed at the rim of the starting structure 11*a*. At the same time, a spherical supporting body 16 is moved up to the rim of the starting structure 11*a* from the other side by means of another robot arm 15*b*. Local support for the wall that is being built up for the component to be produced is thereby achieved, namely precisely at the point of impact of a cold gas jet 17 containing the particles accelerated by the cold spraying nozzle 14.

Figure 2:
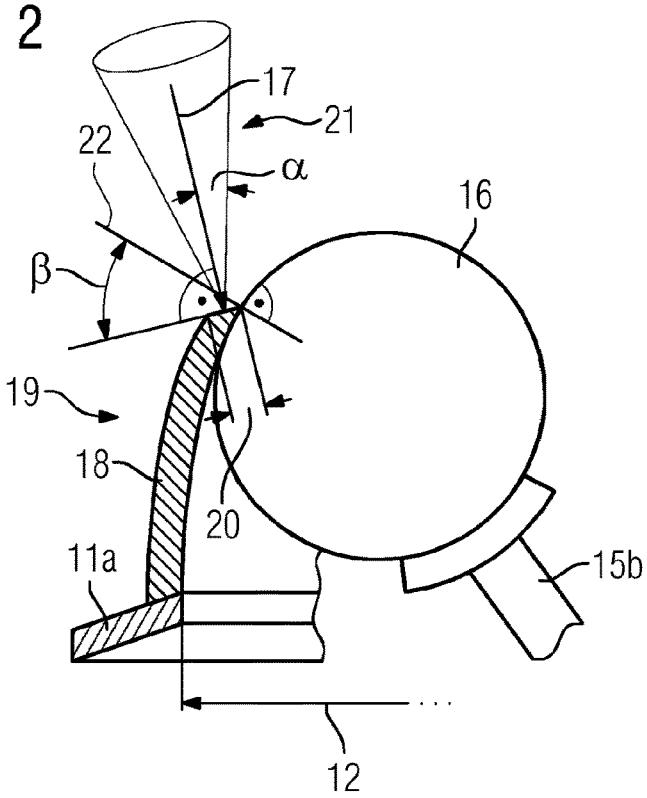

In FIG. 2, it can be seen by way of a detail how a wall 18 of the component 19 to be produced is formed. It can be seen that the position of the supporting body 16 is corrected in such a way that it is always situated at the point of impact of the cold gas jet 17. This jet is directed at the edge 20 of the wall 18 being produced and impinges on the edge 20 precisely at an angle of 90° in the variant shown in FIG. 2.

The spraying angle α is thus 0°. However, as indicated by the cold spraying cone 21, this can also deviate from the 0° shown as long as it lies within the cold spraying cone 21.

It can furthermore be seen that the supporting body 16 hugs the concave inside of the wall 18 in such a way that there is tangential contact between the wall 18 and the surface of the supporting body 16 in the region of the edge 20. Here, the alignment of the edge in relation to a normal 22 to the surface of the supporting body 16 slopes at the angle β, wherein the angle β selected is small enough to ensure that the cold jet 17 is aligned outside the spraying cone (not shown) on the surface of the supporting body (β can also be zero). This prevents particles from being deposited on the surface of the supporting body.

Figure 3:
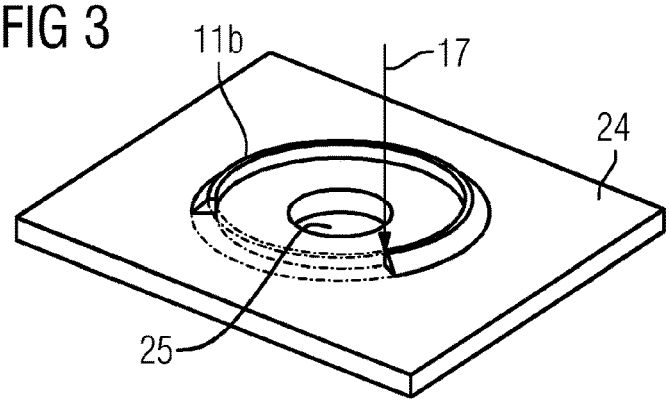
FIGS. 3 to 5 show selected production steps of another illustrative embodiment of the method according to the invention, partially in three-dimensional representation and partially in sectional representation.

In FIG. 3, it can be seen how a starting structure 11*b* is produced on a base 24 in the form of a flat table. During this process, the cold gas jet 17 is directed at this base 24, and thus the annular starting structure is produced. This is advantageously preferably composed of the same material as the wall to be produced. A hole 25 is provided in the center of the base, through which hole the supporting structure 16 (cf FIG. 5) can be inserted into the depression 26 of the shell-shaped component 19.

Figure 4:
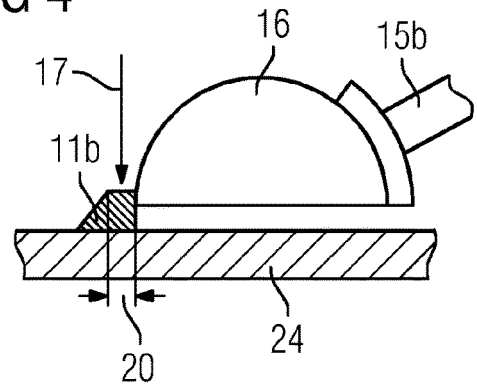

In FIG. 4, it can be seen that the supporting structure 16 used there has the shape of a hemisphere to enable it to be moved up to the edge 20 without interfering with the base 24. In other respects, the production of the wall in accordance with FIG. 4 takes place in the manner already described with respect to FIG. 2.

Figure 5:
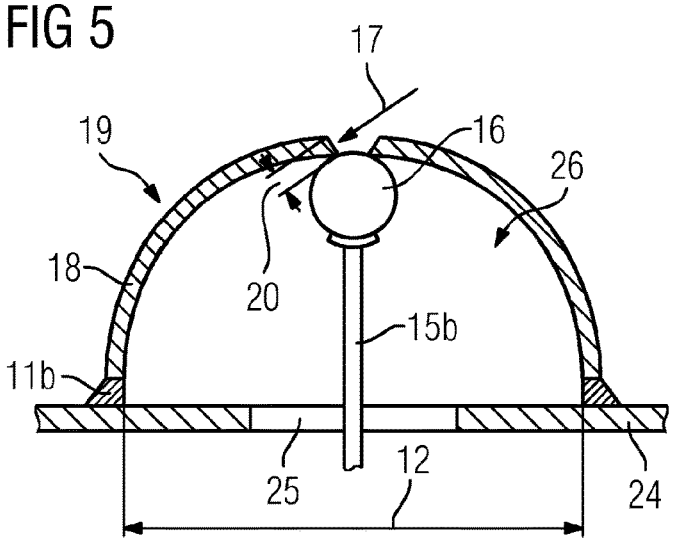

In FIG. 5, it can be seen how the component 19 is being produced just before its final finishing. The wall 18 is already almost closed, wherein the supporting body 16 is moved up to the last open point in the wall through the hole 25 by means of the robot arm 15*b*. The supporting structure 16 is able to completely close the remaining open area of the wall, thus allowing this hole to be closed by means of the cold gas jet 17. The component 19 can then be separated from the base 24 in a manner not shown, e.g. by wire EDM.

Figure 6:
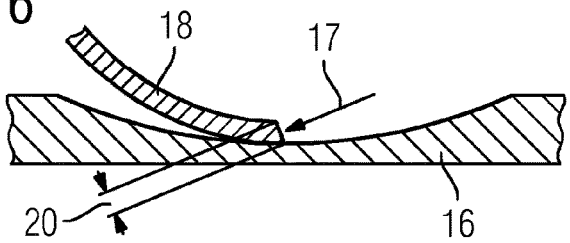
FIG. 6 shows another illustrative embodiment of the method according to the invention in sectional representation.

A concave supporting body 16 is shown in FIG. 6, said body being moved from the outside up to the wall 18 of the component to be produced (not shown in greater detail). It can be seen that the radius of curvature of the concave supporting body 16 can be of a magnitude just sufficient to ensure that the cold gas jet 17 can still be moved up to the edge 20 of the component. A concave supporting body is therefore preferentially suitable for the production of large radii, which would be made more difficult if the supporting body were moved up from the inside.

Figure 7:
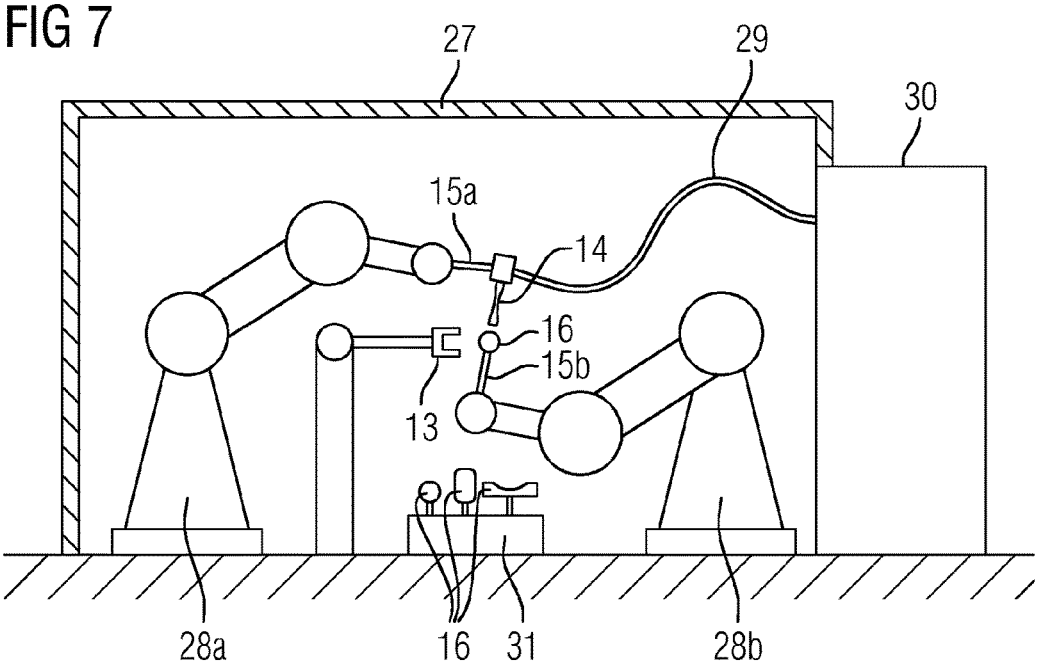
FIG. 7 shows a schematic illustrative embodiment of the production system according to the invention in schematic section.

The illustrative embodiment of the production system according to the invention can be seen in FIG. 7. The production system has a housing 27 to enable it to be filled with a protective gas. Arranged in the housing chamber are two robots 28*a*, 28*b*, which have the robot arms 15*a*, 15*b*. Secured on robot arm 15*a* is the cold spraying nozzle 14, which is connected to a cold spraying system 30 by a flexible line 29. The holding fixture 13 makes it possible to hold a starting structure (not shown). This starting structure can be supported, during production of the wall in accordance with the method already described, by means of the supporting structure 16, the position of which is corrected in a suitable manner by means of the robot 28*b*. If the component to be produced has regions of different diameter, additional supporting bodies 16 are provided in a magazine 31. This magazine 31 can be moved in by robot arm 15*b* to enable the supporting bodies 16 to be exchanged.

The invention claimed is:

1. A method of forming a shell-shaped component by a cold gas spraying process using a cold gas jet of particles, the shell-shaped component having a wall and a depression open toward an opening, wherein the method comprises:

providing a supporting body having a convexly or concavely curved surface formed of a material to which the particles of the cold gas jet do not adhere, bringing the surface of the supporting body into contact with a starting structure that is held by a holding fixture, and delivering the particles via the cold gas jet to an edge of the component being formed, wherein the cold gas jet defines a cold spraying cone through which the particles are delivered, and during the delivery of the particles via the cold gas jet, moving the supporting body and the cold gas jet synchronously such that the cold gas jet impinges on the edge of the component at an angle within the cold spraying cone of the cold gas jet, and wherein the supporting body supports the component being formed at a point of impact of the cold gas jet.

2. The method of claim 1, wherein the component being formed is a bowl-shaped component.

3. The method of claim 1, wherein the component being formed is an electrode shell of a particle accelerator.

4. The method of claim 1, wherein the supporting body is formed from a hard metal.

5. The method of claim 1, wherein the supporting body has a surface having a shape of a sphere or a spherical segment.

6. The method of claim 1, wherein the supporting body has a concave shape.

7. The method of claim 1, wherein the supporting body is formed from titanium or tantalum.

8. The method of claim 1, comprising using a plurality of supporting bodies having curved surfaces with different radii of curvature.

9. The method of claim 1, comprising using a robot arm to control a movement of at least one of the cold spraying nozzle of the supporting body.

10. The method of claim 1, wherein the starting structure comprises a closed ring that defines a rim of the opening of the shell-shaped component, wherein the wall of the component is built up starting from the starting structure.

11. The method of claim 1, wherein the starting structure comprises a closed ring formed on a base by cold gas spraying and defines a rim of the opening of the shell-shaped component, wherein the wall of the component is built up starting from the starting structure.

12. A production system for producing a component, the production system comprising:

a cold spraying nozzle, and a holding fixture having a holder for the component, and a supporting body having a convexly or concavely curved surface, wherein the cold spraying device and the holder are movable relative to one another, and wherein the supporting body is movable related to the holder.

13. The production system of claim 12, wherein the supporting body is secured on a robot arm.

14. The production system of claim 12, wherein the cold spraying nozzle is secured on a robot arm.

* * * * *